US009873061B2

(12) United States Patent
Cheung

(10) Patent No.: US 9,873,061 B2
(45) Date of Patent: Jan. 23, 2018

(54) TOY MAGNETIC CONSTRUCTION PIECES FOR A KIT

(71) Applicant: Jason Cheung, Union City, CA (US)

(72) Inventor: Jason Cheung, Union City, CA (US)

(73) Assignee: Popular Playthings, Union City, CA (US)

( * ) Notice: Subject to any disclaimer, the term of this patent is extended or adjusted under 35 U.S.C. 154(b) by 0 days.

(21) Appl. No.: 14/756,734

(22) Filed: Oct. 6, 2015

(65) Prior Publication Data

US 2017/0095747 A1 Apr. 6, 2017

(51) Int. Cl.
*A63H 33/04* (2006.01)

(52) U.S. Cl.
CPC ..... *A63H 33/046* (2013.01)

(58) Field of Classification Search
CPC ..... A63H 33/046; A63H 33/26
See application file for complete search history.

(56) References Cited

U.S. PATENT DOCUMENTS 5,520,396 A * 5/1996 Therrien ..... A63F 9/34 273/156
5,746,638 A * 5/1998 Shiraishi ..... A63H 33/046 446/131
6,749,480 B1 * 6/2004 Hunts ..... A63H 33/046 446/85
8,070,550 B2 * 12/2011 Song ..... A63H 33/046 446/129
8,128,452 B2 * 3/2012 Kim ..... A63H 33/046 446/129
2009/0181595 A1 * 7/2009 Song ..... A63H 33/046 446/92
2012/0270465 A1 * 10/2012 Park ..... A63H 33/046 446/129
2014/0227939 A1 * 8/2014 Kim ..... A63H 33/046 446/124

FOREIGN PATENT DOCUMENTS

KR WO 2015160060 A1 * 10/2015 ..... A63H 33/04

* cited by examiner

*Primary Examiner* — Gene Kim
*Assistant Examiner* — Alyssa Hylinski
(74) *Attorney, Agent, or Firm* — Jonathan E. Grant; Grant Patent Services

(57) ABSTRACT

A block toy kit is composed of a plurality of magnetic construction units magnetically connectable to each other, wherein at least one of the units comprises a hollow block main body having at least one flat surface portion with at least one magnet holds corresponding to the plural flat surface portion, arranged on inner sides of the respective flat surface portions and having magnet holding portions extending in parallel with said corresponding flat surface portions Permanent magnets are accommodated within the magnet holding portions of said magnet holders for rotation about an imaginary "X-axis" extending at parallel relative to the flat surface portion corresponding to the magnet holding portion.

7 Claims, 13 Drawing Sheets

TOY MAGNETIC CONSTRUCTION PIECES FOR A KIT

BRIEF DESCRIPTION OF THE FIGURES

The accompanying drawings, which are incorporated into and form a part of the specification, illustrate one or more embodiments of the present disclosure and, together with the description, serve to explain the principles of the disclosure. The drawings are only for the purpose of illustrating one or more preferred embodiments of the disclosure and are not to be construed as limiting the disclosure. The dimensions, materials, and specifications described in the drawings illustrate only certain embodiments and may be different for different embodiments. In the drawings.

DETAILED DESCRIPTION OF THE DISCLOSURE

Figure 1:
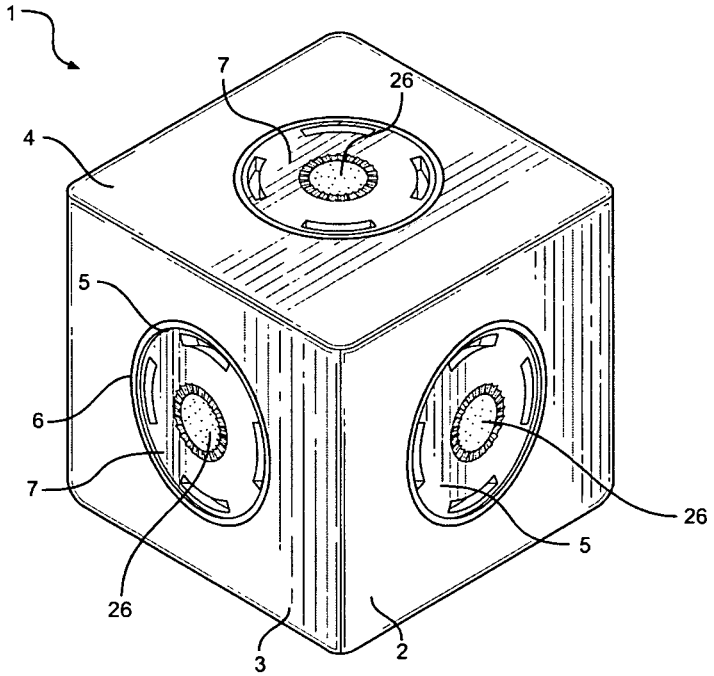
FIG. 1 is a perspective view of a cube shaped magnetic construction unit.
Figure 2:
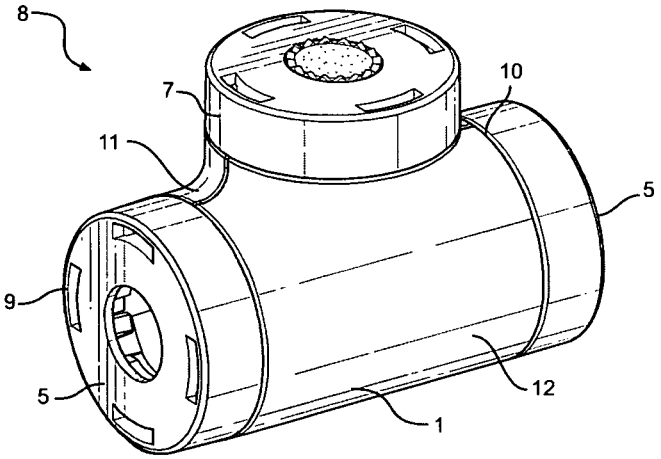
FIG. 2 is a perspective view of a tubular shaped magnetic construction unit.
Figure 3:
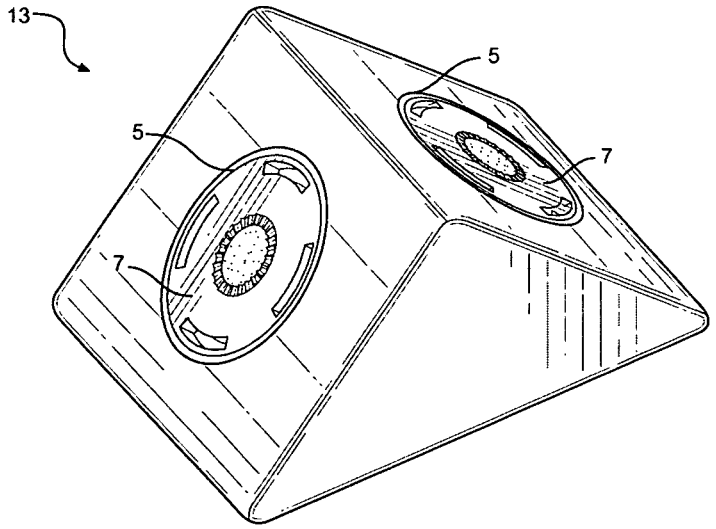
FIG. 3 is an overhead perspective view of a triangular magnetic construction unit.
Figure 4:
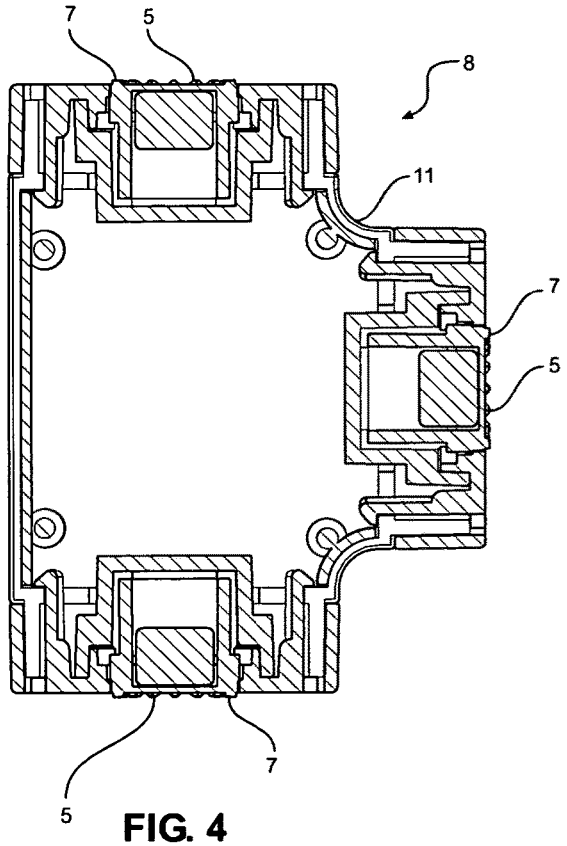
FIG. 4 is a side cutaway view of one embodiment of a magnetic construction unit.
Figure 5:
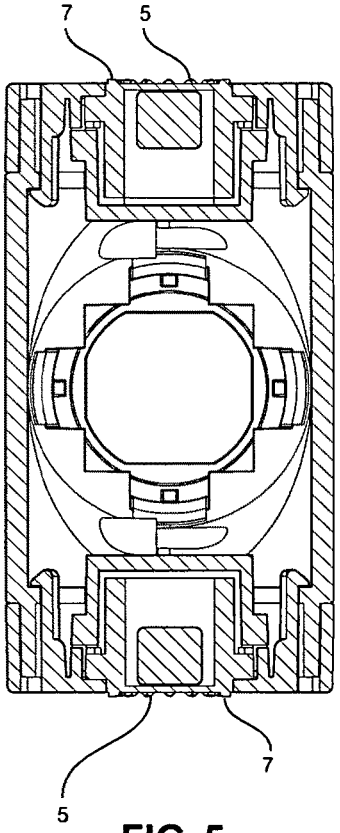
FIG. 5 is a top cutaway view of a magnetic construction unit.
Figure 6:
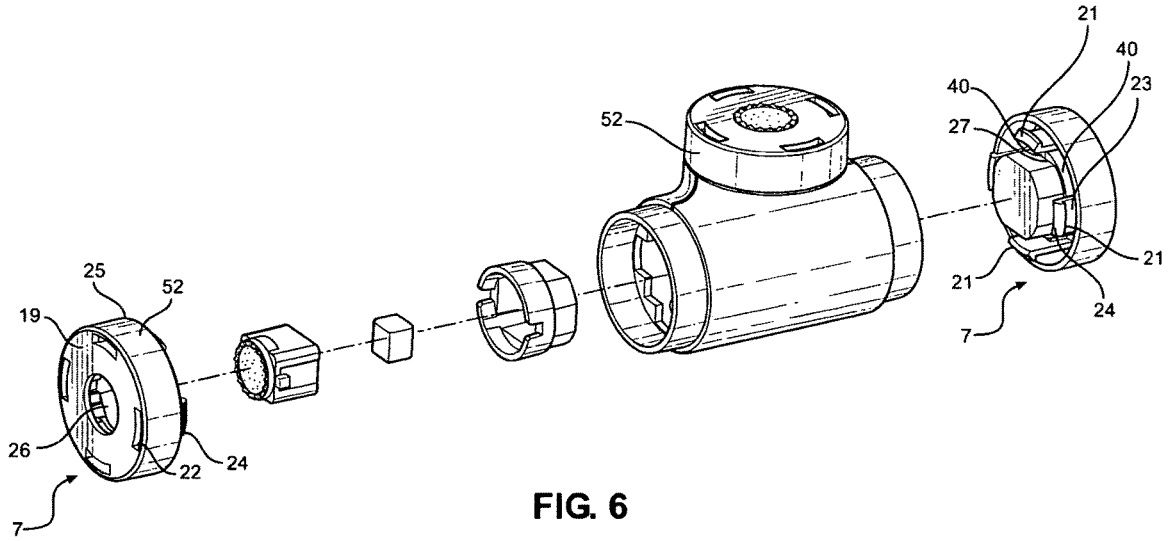
FIG. 6 is an exploded view of a magnet containment assembly and construction unit.
Figure 7A:
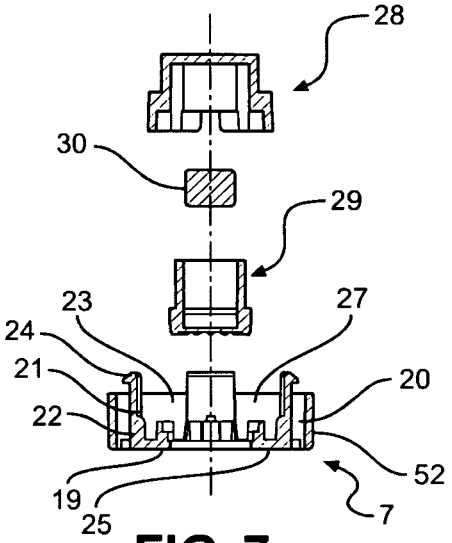
FIG. 7A is a cross sectional view of the magnetic containment assembly.
Figure 7B:
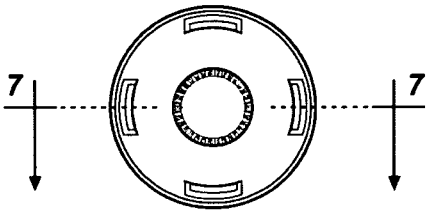
FIG. 7B is a top view of the cap.
Figure 7C:
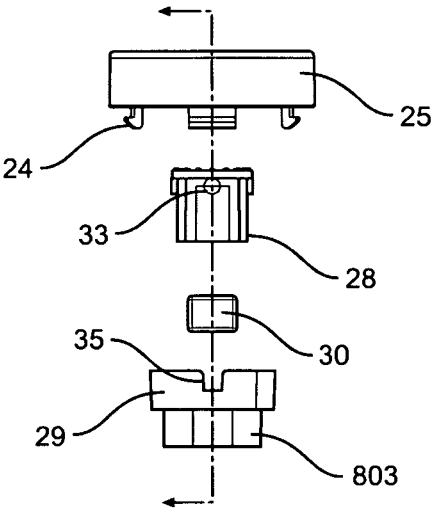
FIG. 7*c* is another side view of the magnetic containment assembly.
Figure 8:
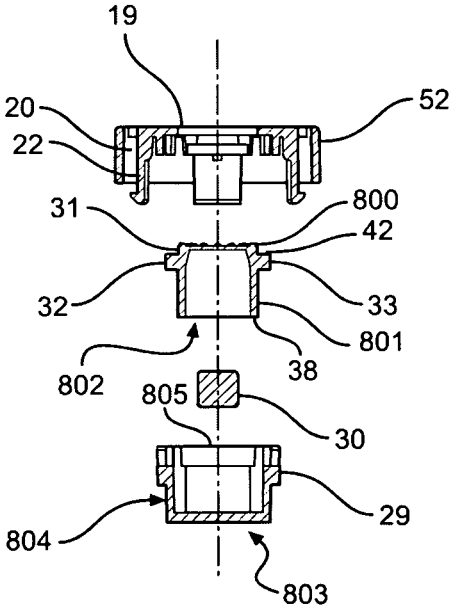
FIG. 8 is a cross sectional cutaway view of another embodiment of the magnet containment assembly.
Figure 9:
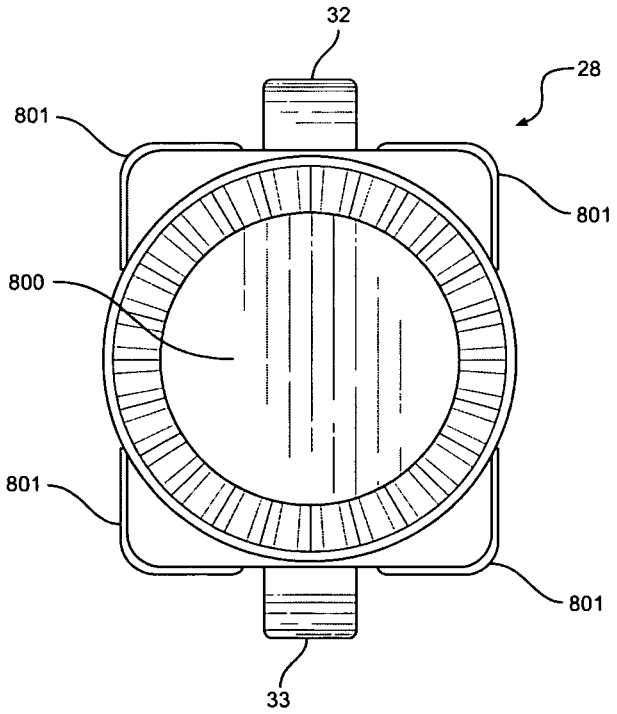
FIG. 9 is top view of the upper magnet cradle.
Figure 10:
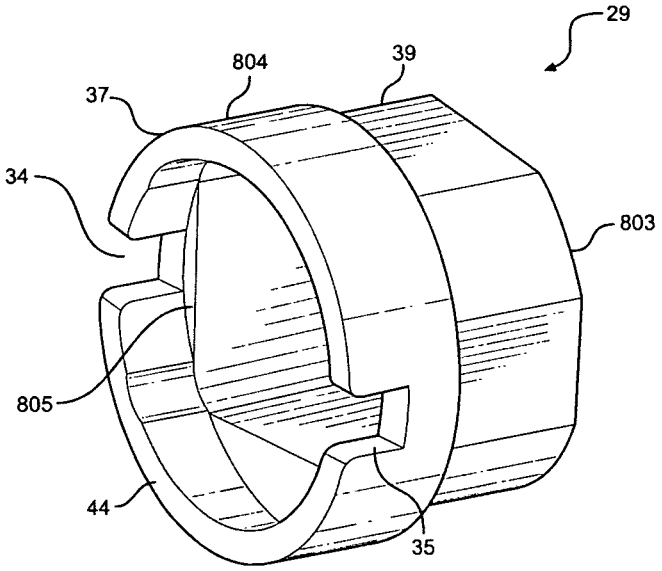
FIG. 10 is a perspective view of the lower magnet cradle.
Figure 11:
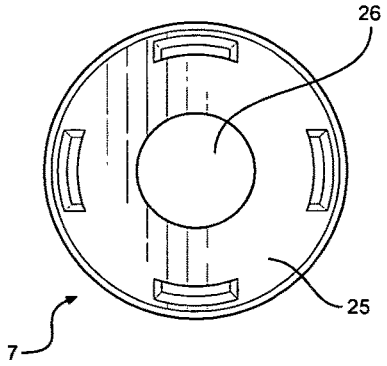
FIG. 11 is a top view of the magnet containment assembly.
Figure 12:
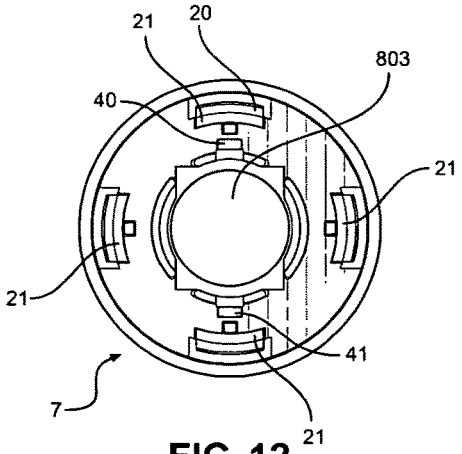
FIG. 12 is a is a bottom view of the magnet containment assembly.
Figure 13:
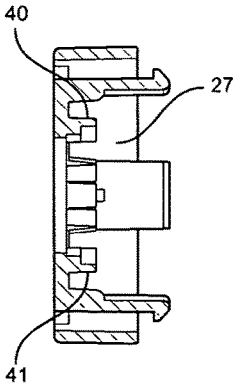
FIG. 13 is a side view of the magnet containment assembly.
Figure 14:
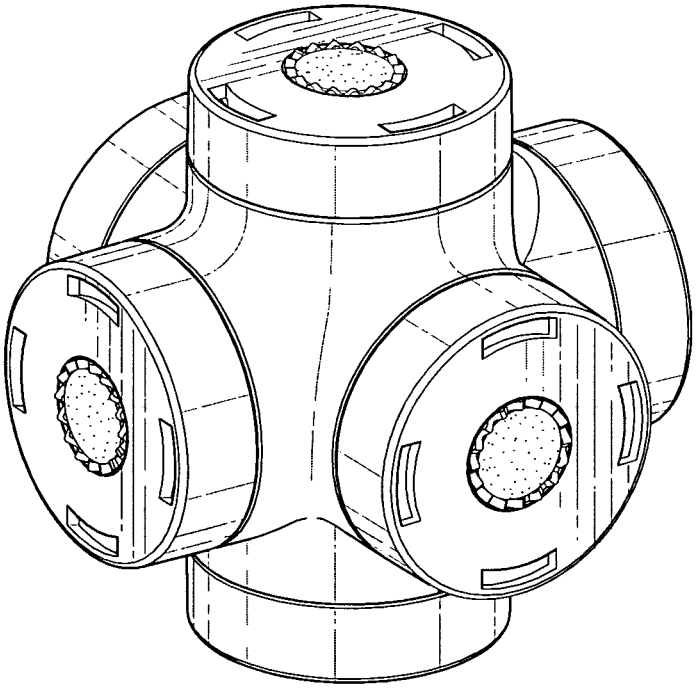
FIG. 14 is a perspective view of a magnetic construction unit, in the shape of a tube having multiple magnetic containment assemblies.

The disclosure describes toy magnetic construction units that, in one embodiment, comprise part of a larger kit of toy magnetic construction unit. The construction units can be varied in shape and size, as long as there is a magnetic containment assembly that cradles the magnet and allows the magnet to rotate about its X axis, if necessary, to magnetically attract to another construction piece.

More specifically, A building block kit is comprised of a plurality of magnetic construction units magnetically connectable to each other, wherein at least one of the units comprises a hollow block main body having at least one flat surface portion with at least one magnet holder corresponding to the plural flat surface portion, arranged on inner sides of the respective flat surface portions and having magnet holding portions extending in parallel with said corresponding flat surface portions Permanent magnets are accommodated within the magnet holding portions of said magnet holders for rotation about an imaginary "X-axis" extending at parallel relative to the flat surface portion corresponding to the magnet holding portion.

Referring to FIGS. 1-17, FIG. 1 shows a toy magnetic construction unit in the shape of a cube 1. As illustrated, the three visible sides 2, 3, and 4 each contain a magnetic containment assembly 5. In one embodiment, the magnetic containment assembly 5 is on all sides of the cube 1. In another embodiment, the magnetic containment assembly 5 is on less than all of the sides of the cube, and in other embodiment, the magnetic containment assembly 5 is found on one or two sides of the cube. There is an opening 6 on each side where there is a magnetic containment assembly. Cap 7 fits within the opening.

In another embodiment, the toy magnetic construction unit is a tube shaped magnetic construction unit 8. Each end 9, 10 of the tube has a magnetic containment assembly 5 with the cap 7 positioned on top of the ends 9, 10 of the tube. In another embodiment, magnetic construction unit 8 has a mount 11 integral and perpendicular to the longitudinal direction of the tube 12.

In another embodiment, the toy magnetic construction unit is a pyramid shaped construction unit 13 having at least containing a magnetic containment assembly 5. In another embodiment, at least two sides of the pyramid shaped construction unit 13 have a magnetic containment assembly, and in another embodiment, all of the sides have a magnetic containment assembly. The various geometric polygonal blocks can be constructed by any methods known in the art.

The cap 7 has a top section 25 having an outside surface 19 and an inside surface 20. Extending downward from the inside surface 20 are prongs 21. The proximal end 22 of the prongs 21 are, in one embodiment, integrally molded with the inside surface 20 of the cap 7. The distal ends 23 of the prongs 21 have catches 24. The prongs 21 and the catches 24 have a limited level of level of flexibility.

The top section 25 further comprises an edge 52 around the circumference of the top section 25 which is flush with the top section and extends downward away from the top section 25, such that the top section resembles a cap, in its shape. In one embodiment, this edge extends part way down along the path of the prongs, but is not as long as the prong.

In another embodiment of the disclosure, there is an opening 26 in the center of the top section 25 of the cap 7. In one embodiment, the opening 26 is circular. In another embodiment, the opening 26 is square, and in yet another embodiment, the opening 26 is rectangular. In yet another embodiment, there is no opening.

Using the circular or round opening 26 as a model (although such an opening is an option), in one embodiment of the disclosure there also exists, on the inside surface 20, a rim 27 around the opening, with various notches 40, 41 in the rim 27. The rim 27 is itself surrounded by the proximal ends 22 prongs 21 which reside outside of the rim 27.

The toy magnetic construction units also include an upper cradle 28 which fits within a lower cradle 29, and together the upper cradle 28 and the lower cradle 29 in turn cradle a magnet 30. More precisely the magnet 30 sits in the upper cradle 28 which is encased by the lower cradle 30. In one embodiment, the magnet 30 is rectangular in shape and when exposed to another magnetic polar force, can rotate upon its X axis. In one embodiment, the magnet 30 can only rotate about its X axis. In another embodiment, the upper cradle 28 is rectangular in shape. In yet another embodiment, the lower cradle 29 is also rectangular in shape. The purpose of the cradles being rectangular in shape is to limit the movement of the magnet 30 such that it can only turn on its X axis, although in one embodiment, the elongated nature of the magnet is such that it can only rotate on its X axis to present the appropriate polar attraction to the other construction unit. The upper cradle 28 has a bottom 800, sides 801 surrounding the bottom 800 and an opening 802 at the distal end of the upper cradle 28. In one embodiment the bottom 802 fits within the opening 26 of the cap 5. The lower cradle 29 has a bottom 803, sides 804 around the bottom 803, and an opening 805 at the distal end of the lower cradle 29.

In yet another embodiment, the proximal end 31 of the upper cradle 28 further comprises at least two arms 32, 33 which extend outward from the edge 42 of the proximal end 31, with the distal end 38 having opening 802, forming an upside down cup-like structure. In an alternative embodiment, there could be more than two arms 32, 33 extending outward at the proximal end 31.

Complementing the two arms 32, 33 are two cutaway sections 34, 35 in the edge 44 the distal end 37 of the lower cradle 29, which is hollow and has the opening 805. The upper cradle 28 fits upside down into the lower cradle 29 with the arms 32, 33 of the upper cradle 28 fitting into the cutaway sections 34, 35 of the of the lower cradle.

Prior to the combination of the upper cradle 28 and the lower cradle 29, the magnet 30 is inserted into one of the two cradles. The cradles are put together with the distal end of the upper cradle 28 fitting into the distal end 37 of the lower cradle 29.

In one embodiment of the disclosure, the distal end 37 of the lower cradle 29 is wider, or has a greater diameter, than the proximal end 39 of the lower cradle 29. More specifically, the diameter of the distal end 37 of the lower cradle 29, measured from the inside of the walls of the distal end 37 of the lower cradle 29 is greater than the outer width of the rim 27 of the cap 7. In another embodiment, outer diameter of the upper cradle 28 is less than the inner diameter of the rim 27 of the cap 7.

The edge 42 of the proximal end of the upper cradle 28 is fitted within the rim 27 of the inside surface of the top section 25 of the cap 7. The edge 44 of the distal end 37 of the lower cradle 29 fits around the outside of the rim 27. This forms the magnetic containment assembly 5, described supra. The upper cradle 28 and the lower cradle 29 are glued into the cap 7. In one embodiment, the individual pieces snap together. In another embodiment, the arms 32, 33 of the upper cradle 28 fitting into the cutaway sections 34, 35 of the of the lower cradle fit within the notches 40, 41 of the rim 29.

The magnetic containment assembly 5 described, supra fits within and to a mount 60 within the wall 100 of the toy magnetic construction unit 1. In a polygonal structure, the magnetic containment assembly 5 can be flush with the wall 100, slightly above the wall 100, or slightly indented 100. The mount 60 has an opening 18 that corresponds to the shape of the cap 7. If the cap 7 is circular, the opening 18 will be circular. The opening can be triangular, rectangular, pentagonal, etc. or even amorphous in shape, as long as the shape of the cap 7 can correspond to and fit within the opening 18.

A wrap-around wall 61 of the mount 60 is positioned perpendicular and beneath the surface of the wall 25 or, in the case of tube shaped magnetic construction unit 8. A floor 62 is connected to the wall 25. The floor 62 has a central opening 63 and has a shape through which the proximal end of the lower cradle 29 will fit. It should be noted that while the proximal end of the lower cradle 29 fits through the central opening, the distal end 37 of the lower cradle 29, does not pass through, due to the fact that the width of the distal end 37 of the lower cradle 29 is greater than the width of the central opening 63 of the mount 60.

Surrounding the central opening 63 are slits 64, 65, 66, and 67, through which the catches 24 of the resilient prongs go and are secured.

Figure 15:
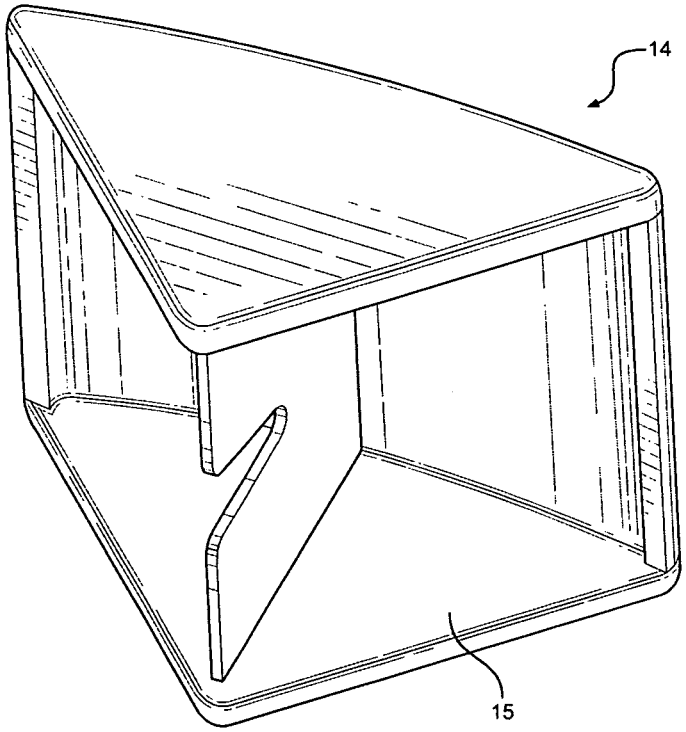
FIG. 15 is a perspective view of a magnetic construction unit without the sides containing the magnetic containment assembly.
Figure 16:
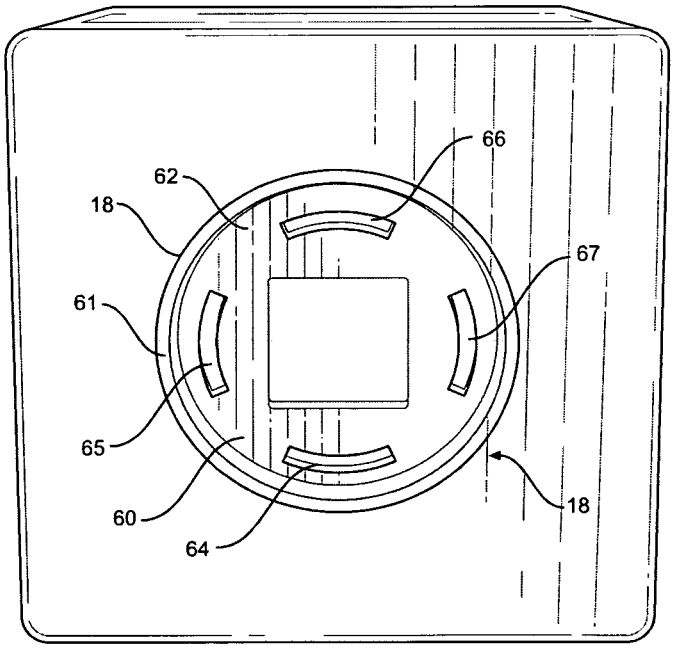
FIG. 16 is a perspective view of the mount.
Figure 17:
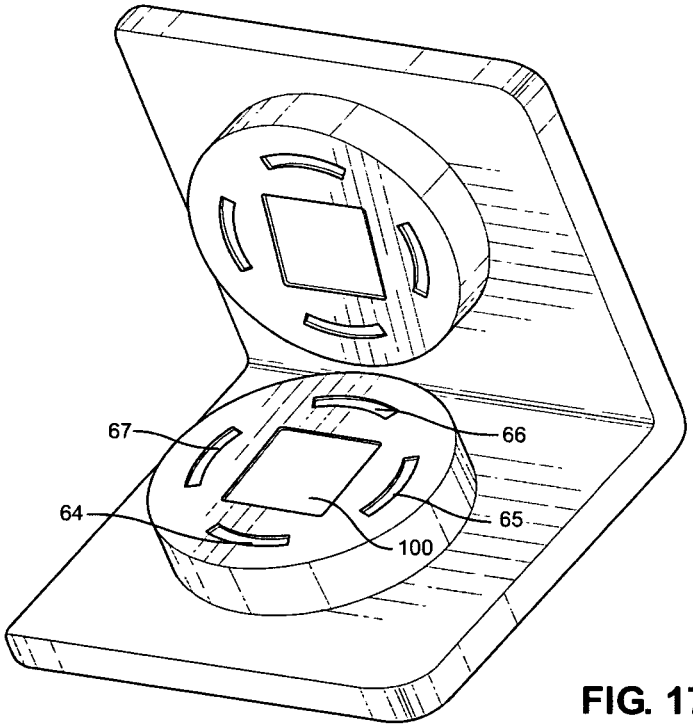
FIG. 17 is a rear view of the mount.

In one embodiment as shown in FIG. 15, a shaped construction unit 14 has a rim with a female shelf 15. A complementary shelf rim 16 is found on the wall 17 which contains the magnetic containment assembly 5. There are numerous ways, known in the art, to connect the walls of the polygon to the body of the polygon, including glue, pegs, etc. Walls containing the magnetic containment assembly can be connected to other walls by glue, the use of female-male connectors, or another common means. Any method of securing the walls together is acceptable.

The magnetic construction units are assembled together by having the magnetic containment assemblies 5 of each of the magnetic constructions units face each other. The magnets inside the assemblies 5 will rotate about their axis until a south pole is facing a north pole, and at that point, the two units will "stick" together by magnetic force.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

I claim:

1. A magnetic construction unit, said construction unit comprising:

a) at least one magnetic containment assembly, said assembly comprising:
  i) a cap, said cap comprising:
    A) a top portion, said top portion comprising:
      1) a top side, said top side having a centered opening:
      2) a bottom side;
    B) a rim around the top portion of the cap,
    C) a plurality of resilient prongs having catches at a distal end of said resilient prongs, said resilient prongs protruding from said bottom side of said cap;
  ii) an upper cradle, said upper cradle comprising:
    A) a top section, said top section comprising:
      1) a central section that fits within the centered opening of the top side of the top portion of said cap to close the centered opening;
      2) a polygonal base upon which said central section is situated;
      3) a plurality of downwardly facing walls, a top of each of said walls attached to each side of said polygonal base;
  iii) a lower cradle, herein said upper cradle positioned within said lower cradle;
  iv) a rectangular magnet enclosed within said upper cradle and said lower cradle;

b) a mount, said mount having openings in which said catches of the resilient prongs fit, said mount allowing for the attachment of the magnetic containment assembly within the magnetic construction unit, wherein said upper cradle and said lower cradle are fixedly secured to said cap and wherein a space within an area defined by the upper cradle and the lower cradle in which the rectangular magnet is enclosed is only large enough to allow the magnet to rotate about its X axis.

2. The magnetic construction unit of claim 1, further comprising:

a) at least two arms extending outward from an edge of a proximal end of said upper cradle; and b) at least two cutaway sections in an edge of a distal end of the lower cradle, wherein the upper cradle fits upside down into the lower cradle with each of the two arms of the upper cradle fitting into each of the the cutaway sections of the lower cradle.

3. The magnetic construction unit of claim 2 further comprising a second rim around the centered opening of the cap on an inside of said cap wherein the edge of the proximal end of the upper cradle is fitted within the second rim and the edge of the distal end of the lower cradle is fitted around an outside of the second rim.

4. The magnetic construction unit of claim 3, wherein the distal end of the lower cradle is wider than a proximal end of the lower cradle.

5. The magnetic construction unit of claim 4, wherein said lower cradle is rectangular in shape.

6. The magnetic construction unit of claim 5, wherein said upper cradle is rectangular in shape.

7. The magnetic construction unit of claim 4, wherein said mount further comprises:

a) a sunken floor;

b) a wall wrapped around the sunken floor; and c) a central opening through which fits the proximal end of the lower cradle.

* * * * *